US006091059A

United States Patent [19]

Sato et al.

[11] Patent Number: 6,091,059

[45] Date of Patent: Jul. 18, 2000

[54] HEAT ROLLER DEVICE

[75] Inventors: Hiroto Sato, Himeji; Kazuhiro Akiyama, Takassago, both of Japan

[73] Assignee: Ushiodenki Kabushiki Kaisha, Tokyo, Japan

[21] Appl. No.: 08/712,118

[22] Filed: Sep. 11, 1996

[30] Foreign Application Priority Data

Sep. 11, 1995 [JP] Japan ..... 7-257230

[51] Int. Cl.[7] ..... G03G 15/20

[52] U.S. Cl. ..... 219/469; 219/216; 219/478; 399/334

[58] Field of Search ..... 219/216, 470, 219/469; 399/334; 492/46; 432/60

[56] References Cited

U.S. PATENT DOCUMENTS

| | | | |
|---|---|---|---|
| 4,009,953 | 3/1977 | Ravizza et al. | 219/216 |
| 4,075,455 | 2/1978 | Kitamura et al. | 219/216 |
| 4,801,968 | 1/1989 | Kogure et al. | 219/216 |
| 5,171,969 | 12/1992 | Nishimura et al. | 219/216 |
| 5,204,723 | 4/1993 | Hanada et al. | 219/216 |
| 5,241,159 | 8/1993 | Chatteriee et al. | 219/470 |
| 5,402,211 | 3/1995 | Yoshikawa | 219/216 |

*Primary Examiner*—Teresa J. Walberg
*Assistant Examiner*—J. Pelham
*Attorney, Agent, or Firm*—Sixbey, Friedman, Leedom & Ferguson; David S. Safran

[57] ABSTRACT

A low cost, compact heat roller device is provided which includes a heat generating resistance for increasing the temperature of the heat roller wherein the heat generating resistance is divided into two parts in order to correspond to passage widths of different recording materials. The heating power of one of these heat generating resistances is changed and the temperature increase of a non-paper transport area of the heat roller is suppressed. Specifically, the heat roller device includes a heat roller and a press roller opposite the heat roller, two heat generating resistances formed on an outer surface of the heat roller which generate heat independently of one another, a common electrode for supplying current and separately arranged additional supply electrodes. The time during which the respective heat generating resistance is on, is changed, in relative terms, according to the object to be heated, and thus the heating power is changed.

2 Claims, 10 Drawing Sheets

HEAT ROLLER DEVICE

BACKGROUND OF THE INVENTION

1. Field of the Invention

The invention relates to a heat roller device and especially to heat roller device for use in a heat roller system which is used in an electrophotographic copier, a laser printer, a fax machine, and the like, to fix a toner image.

2. Description of Related Art

Conventionally, in an electrophotographic copier or the like, a heat roller system is widely used to thermally fix a toner image formed on recording material. Typically, the unfixed toner image, positioned on the recording material, is fixed on the recording material by one pass of the recording material between a heat roller and press roller located opposite it.

In a conventional fixing device of the heat roller type, a heat roller includes a hollow metal tube with an offset prevention layer consisting of fluororesin, or the like, formed on its outer surface and a heat lamp, such as a halogen lamp or the like, positioned in the interior of the tube, as disclosed in published utility model JP HEI 3-45248 or JP patent disclosure document HEI 5-19659.

Furthermore, JP patent disclosure document SHO 55-72390 discloses a process in which, instead of a heating lamp being used as the heat means of the heat roller, the surface of cylindrical insulating material is provided with a heat generating resistance body so that the heat roller itself produces heat by turning on this heat generating resistance body.

In above-described fixing devices, first the heat roller is heated by supplying power to the heat lamp or heat generating resistance body to raise the temperature of its outer surface up to a fixing temperature (for example, up to 180° C.), which is also referred to as "preheating". After the outer surface of the heat roller has reached the fixing temperature, the surface temperature of the heat roller is regulated. This regulated surface temperature is called the setting temperature while this operation is called "stand-by". This is done by regulating the power supplied to the heat lamp or the heat generating resistance body by means of a signal from a temperature sensor which determines the surface temperature of the heat roller. By one pass of the recording material between the temperature-controlled heat roller and the press roller, hereinafter referred to as "fixing work", the not yet fixed toner is heated as it is squeezed and thus the toner image is fixed on the recording material.

In an electrophotographic copier and the like, the recording material may be subjected to fixing work without interruption, with a passage width which is smaller (for example, transverse width of a B5 form) than the maximum passage width provided for the device (for example, transverse width of A3 form). In this case, the entire area of the maximum passage width of the heat roller is heated by the heat lamp or the heat generating resistance body and is also temperature controlled. If the recording material and the heat roller do not come into contact with one another, hereinafter referred to as the "non-paper transport area", to the same degree, an abnormal temperature increase occurs, to a slight extent, in which less heat is removed from it by the recording material compared to the part in which the recording material and the heat roller come into contact with one another, hereinafter referred to as the "paper transport area".

In the case in which, immediately following the above-described state, recording material with a large passage width, for example, an A3 form, is subjected to fixing work, scattering of the fixing property of the toner occurs due to the phenomenon of high temperature offset, or the like, which is caused by overmelting of the toner in the part with a high temperature as a result of the nonuniform temperature distribution of the heat roller.

Also, the excess temperature increase of the non-paper transport area in the longitudinal directions of the heat roller and the press roller causes thermal stress by which the durability of the heat roller and the press roller is highly adversely affected. The heating of the non-paper transport area also results in the excess power consumption.

To improve this situation, a process was devised in which the longitudinal direction of the heat roller surrounding the heat generation area of the heat lamp or heat generating resistance body is divided into at least two parts. Thus the width of the heat generating area is switched according to the passage width of the recording material, as disclosed, for example in JP patent HEI 3-1666 or JP patent disclosure document SHO 59-197067 and the like.

In the above described conventional process in which, the heat generating width in the longitudinal direction of the heat roller is switched according to the respective passage width of the recording material, it is, however, necessary to increase the number of areas to be divided accordingly as the number of different passage widths increases. If the number of divisions of the heat generating area is increased, both the number of electrodes for supplying the heat lamp or the heat generating resistance body as well as the number of switching elements for switching the heat generation width increase accordingly, causing the device to become complex and thus increasing costs.

Especially in the method using the heat lamp, the number of heat lamps having heat generating areas with different widths increase. Thus, it is necessary to make room available for arrangement of these several heat lamps in the interior of the heat roller. Therefore the diameter of the heat roller cannot be reduced; this, together with the increasing number of the above described components, prevents the device from being made smaller and compact.

As is described above, in a conventional heat fixing device, with the method in which, according to the passage width of the recording material, the heat generating width is switched in order to correspond to recording materials with different passage widths, the disadvantages include a complicated configuration, high costs and difficulty of reducing the size of the device and making it compact.

SUMMARY OF THE INVENTION

The invention was devised to operate the above described disadvantages. The first object of the invention is to devise a heat roller device with a simple configuration, low costs and a small shape, in which a heat generating resistance body for increasing the temperature of the heat roller is divided into two parts, in order to correspond to passage widths of different recording materials, and in which these two heat generating resistance are turned on by three feeding rings.

Another object of the invention is to devise a heat roller device in which, by reducing the degree of heat generation of a heat generating resistance which is present in the non-paper transport area of the heat roller, the temperature increase of the non-paper transport area of the heat roller can be suppressed.

The objects are achieved according to the invention by providing a heat roller device which has a heat roller and a press roller opposite the heat roller, and wherein, between the two rollers, an article to be heated passes. The above described heat roller consists of a generally cylindrical base material, that includes two heat generating resistances are formed on its outside which each generate heat independently of one another. The above described two heat generating resistances are provided with a common electrode for purposes of supply and with separately arranged additional electrodes for purposes of supply. The time during which the respective heat generating resistance is on, is changed, in relative terms, according to the object to be heated, and thus the heating power is changed.

The objects of the invention are furthermore achieved by the above described article to be heated being a recording material on which a toner image is formed and by the above described toner image being fixed.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
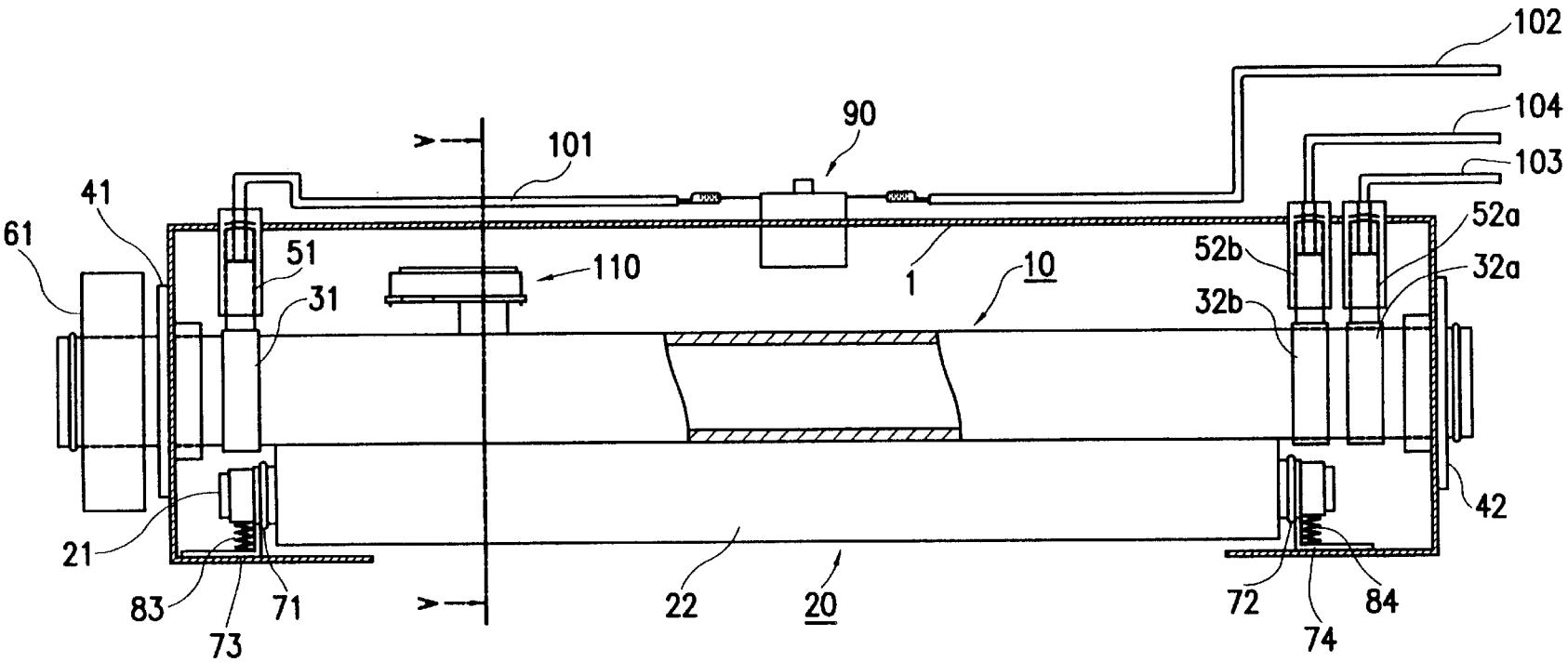
FIG. 1 schematically shows a partial section front view of one embodiment of the heat fixing device according to the invention.
Figure 2:
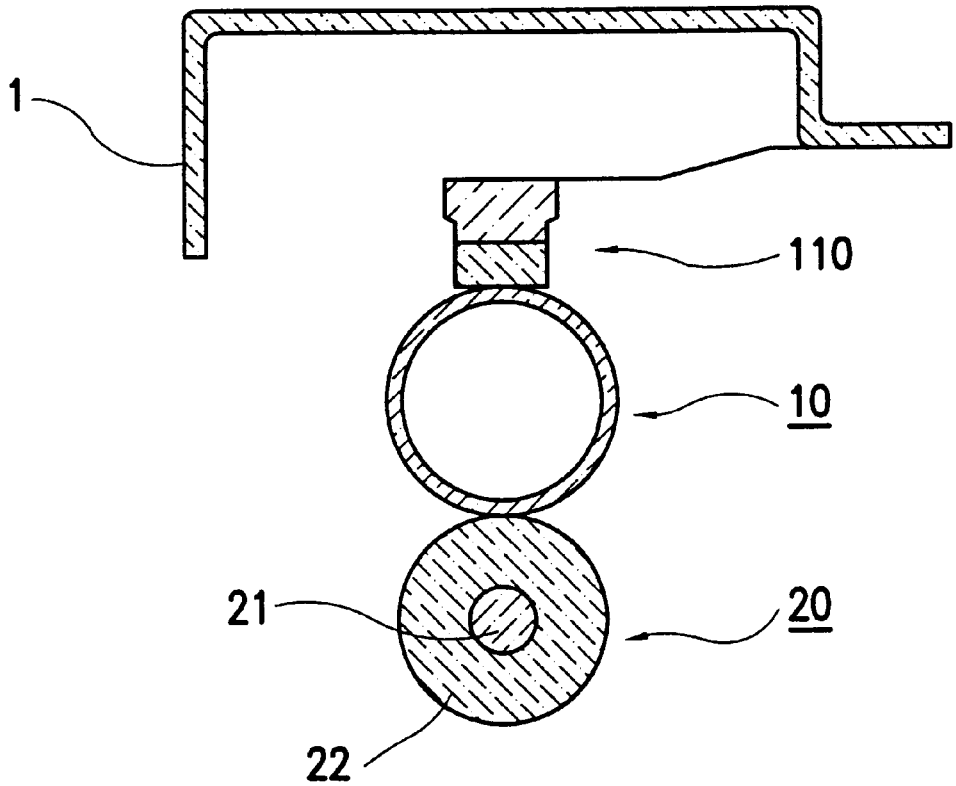
FIG. 2 schematically shows a cross sectional representation which corresponds to line A—A in FIG. 1 in the direction of the arrow.

FIG. 1 is a partial section front view of a heat fixing device which shows one example of a heat roller device according to the invention. FIG. 2 is a cross sectional representation which corresponds to line A—A in FIG. 1 in the direction of the arrow.

In FIGS. 1 and 2, reference number 10 indicates a heat roller which is pivotally held via heat-resistant heat roller bearings 41, 42 on the sides of retaining frame 1. Reference numbers 31, 32*a* and 32*b* indicate feeding rings on heat roller 10 and reference numbers 51, 52*a*, and 52*b* indicate feeding brushes for applying voltage to feeding rings 31, 32*a* and 32*b*. Furthermore, reference number 61 indicates a driving gear for a rotary drive of heat roller 10 which engages a split part which is located on one end of heat roller 10. The rotary drive power is transmitted by a drive motor not shown in the drawing to heat roller 10 via driving gear 61.

Reference number 20 indicates a press roller as a pressure roller. Press roller 20 consists of metal shaft 21 and elastic layer 22 which is formed in its vicinity, which is resistant to heat, and which is arranged such that its principal direction agrees with the principal direction of heat roller 10.

The two ends of press roller 20 are mounted to move up and down and also to pivot via press roller bearings 71, 72 in bearing plates 73, 74. Furthermore, reference numbers 83 and 84 indicate compression springs which are arranged such that they each force press roller bearings 71 and 72 upward. In this way, press roller 20 is moved upward and is pressed oppositely against heat roller 10. If in this state heat roller 10 is turned via driving gear 61, press roller 20 turns, following the roller.

Feeding brush 51 is subject to a relay connection on line 102 via line 101 and temperature determination relay 90. Feeding brush 52*a* (52*b*) is subject to a relay connection on line 103 (104). Reference number 110 indicates a temperature sensor for determining the surface temperature of heat roller 10 and which is located in a position which corresponds to an overlapping site through which the recording materials with different passage widths pass.

Figure 3:
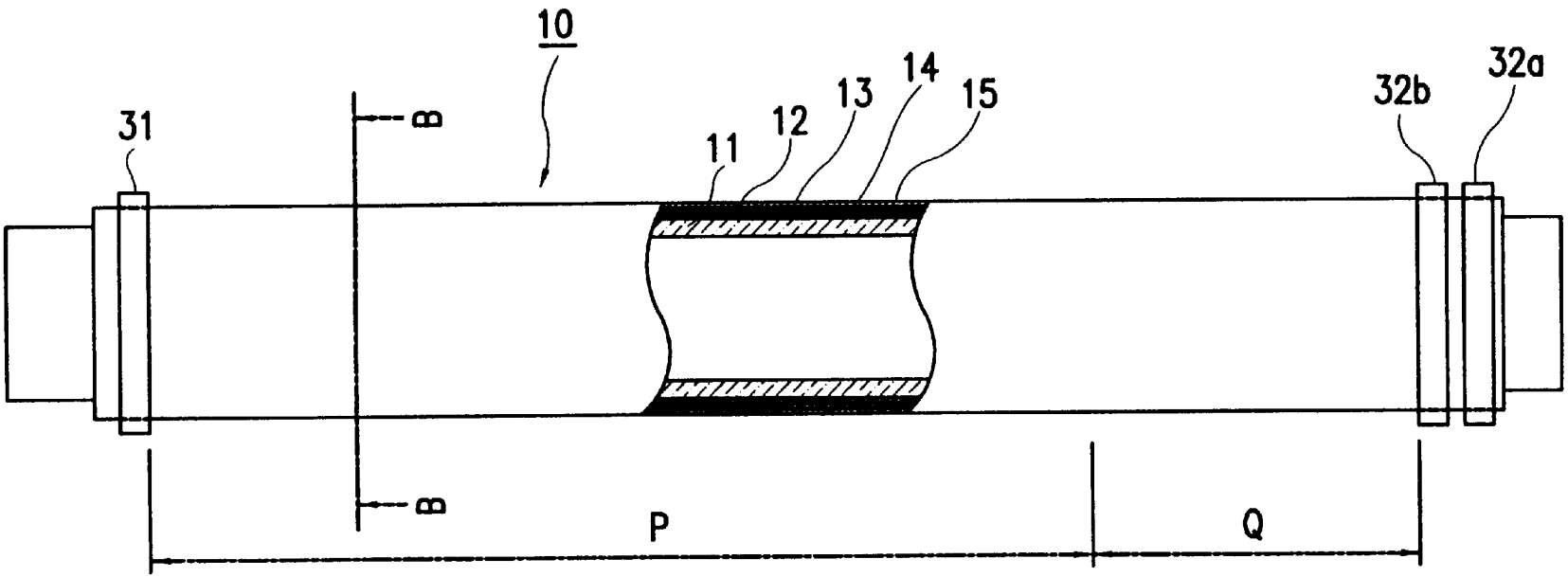
FIG. 3 schematically shows a partial section front view of one specific arrangement of the heat roller.
Figure 4:
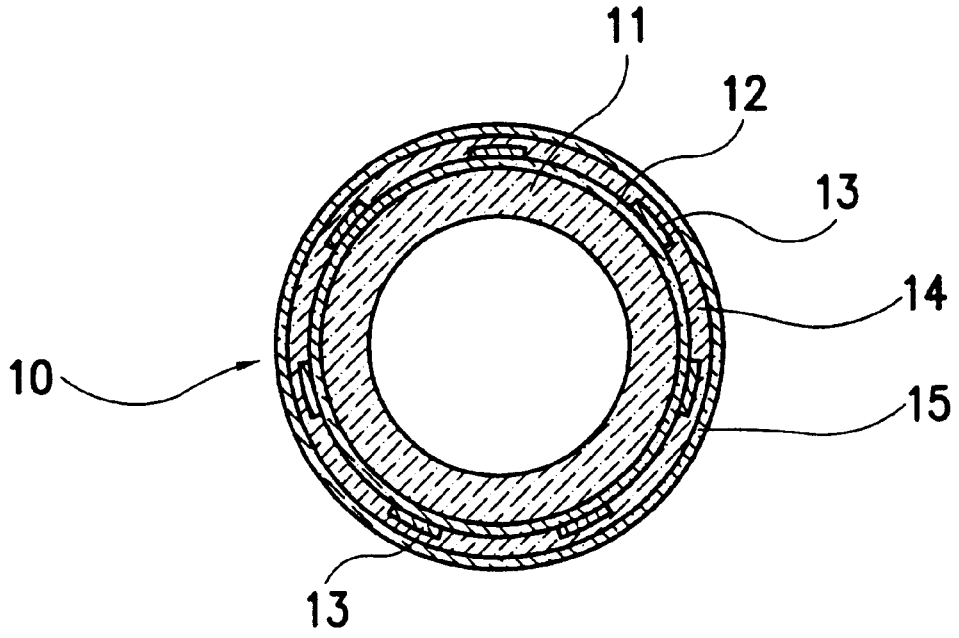
FIG. 4 schematically shows a cross sectional representation which corresponds to line B—B in FIG. 3 in the direction of the arrow.

FIG. 3 is a cross sectional front view of a specific arrangement of the heat roller. FIG. 4 is a cross sectional representation which corresponds to line B—B in FIG. 3 in the direction of the arrow. FIG. is a typical model of a heat generating resistance which forms heat roller 10.

As is apparent from FIGS. 3 and 4, heat roller 10 which forms the heat roller device according to the invention consists of a rotary, rod-shaped heat element which has cylindrical base material 11, insulating film 12 formed on the outside surface of cylindrical base material 11, heat generating resistance 13 which is formed on insulating film 12, protective film 14 which is formed such that it coats heat generating resistance 13, offset prevention layer 15 formed on this protective film 14, and feeding rings 31, 32*a*, and 32*b* for purposes of supplying current to heat generating resistance 13.

Cylindrical base material 11 is a cylindrical component which has an outside diameter of 32 mm, a thickness of 1.5 mm and a total length of 378 mm. It is desirable that this cylindrical base material, with respect to preventing temperature nonuniformity on the surface of heat roller 10, consists of a metal material with high thermal conductivity, especially of a metal material with a thermal conductivity of greater than or equal to 100 W/(m.K). Specifically, it is desirable that it consists of aluminum alloy. By using aluminum alloy as the cylindrical base material, a more uniform surface temperature of heat roller 10 can be achieved.

Insulating film 12, formed on cylindrical base material 11, consists of an insulator with aluminum oxide, silica, or the like, as the main component.

It is desirable that the layer thickness of insulating film 12 be 50 to 100 microns. In this embodiment, aluminum oxide with a thickness of approximately 70 microns is used.

Heat generating resistance 13 consists of a strip-shaped body with a width of 0.5 mm to 3 mm and a thickness of approximately 10 microns and contains silver as the conductive material. In the invention, silver-palladium (Ag—Pd) alloy is used as the material which forms heat generating resistance 13. The thickness of heat generating resistance 13 is selected with consideration of the service life reliability (durability) and the like, and is specifically in the range from 5 to 20 microns. It is desirable that the thickness lie in the range from 10 to 15 microns.

In the case of a thickness of heat generating resistance 13 of less than 5 microns, when it is turned on, the heat generating resistance often burns or the like, resulting in a short service life reliability. On the other hand, in the case in which the thickness of heat generating resistance 13 is overly large, the adhesive joining strength between heat generating resistance 13 and insulating film 12 decreases; this likewise causes a decrease of service life reliability.

As for a process for forming heat generating resistance 13, any conventional process may be used. However a screen printing process is desirable because, in this way, a heat generating resistance with a thickness from 5 to 20 microns can be easily formed.

Figure 5:
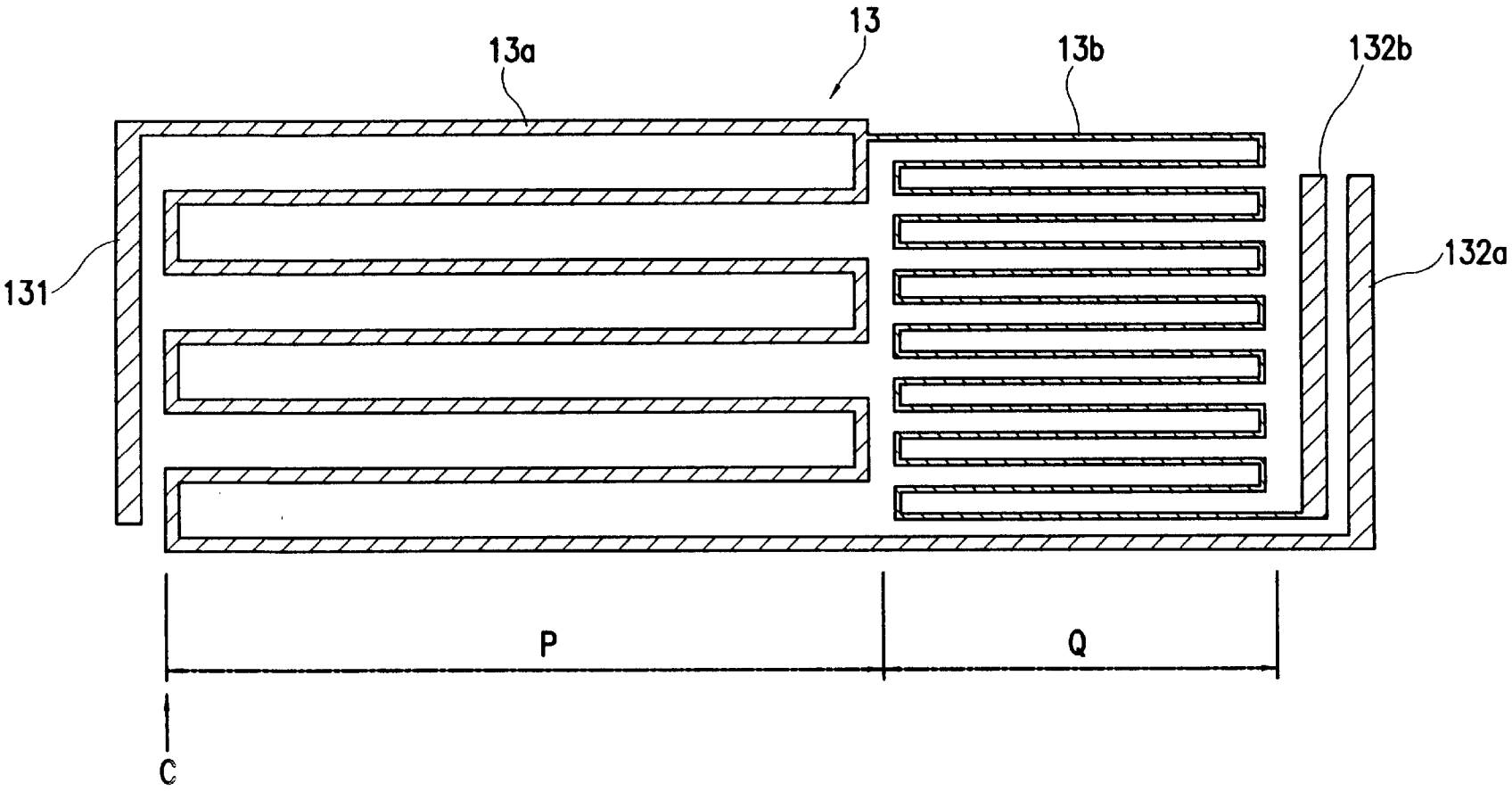
FIG. 5 schematically shows a typical model of a heat generating resistance which forms the heat roller.

In FIG. 5, reference numbers 13*a* and 13*b* indicate heat generating resistances which form heat generating resistance 13. By supplying current to first heat generating resistance 13*a*, mainly first area P is heated in the longitudinal direction of heat roller 10, and by supplying current to second heat generating resistance 13*b*, mainly second area Q is heated in the longitudinal direction of heat roller 10.

Reference number 131 indicates an electrode, for supplying current, is common to heat generating resistance 13*a* and heat generating resistance 13*b*. Reference numbers 132*a* and 132*b* indicate electrodes for purposes of supply which are each located on the other ends of heat generating resistances 13*a* and 13*b*. Feeding rings 31, 32*a* and 32*b* are each electrically connected to electrodes 131, 132*a* and 132*b*.

By applying voltage between feeding ring 31 and feeding ring 32*a* current flows into first heat generating resistance 13*a*, and mainly first area P is heated. By applying voltage between feeding ring 31 and feeding ring 32*b*, current flows into second heat generating resistance 13*b*, and mainly second area Q of the heat roller is heated. In this embodiment, it is not provided that current be supplied only to second heat generating resistance 13*b*.

In FIG. 5, the sum of the lengths in the longitudinal directions of first area P and second area Q is set to a length of 310 mm which is slightly larger than one transverse width of the A3 form of 297 mm, which is the maximum passage width of the recording materials in this embodiment. The width of first area P is set to a length of 230 mm, which is approximately the transverse width of the relatively frequently used A4 form. Reference letter C indicates a reference position for feed of the recording materials.

Protective film 14 is a film with a thickness of 50 microns which consists of an insulator composed primarily of aluminum oxide, silica or the like. The insulator is positioned for preventing the deterioration of heat generating resistance 13, ensuring electrical insulation, preventing damage to heat generating resistance 13 by a foreign body, and the like. The thickness of protective film 14 is usually less than or equal to 100 microns. The desired thickness thereof is 50 to 80 microns. In the case in which the thickness of the protective film is greater than 100 microns, heat transfer to the outside surface of heat roller 10 is made more difficult, resulting in the danger that the heating efficiency will be adversely affected.

Offset prevention layer 15 is a fluororesin layer which is located on the surface of heat roller 10 to increase releasability. Due to the placement of offset prevention layer 15, the phenomenon of offset no longer frequently occurs in fixing work, and thus advantageous fixing efficiency can be obtained.

Feeding rings 31, 32*a* and 32*b* are ring-shaped parts which each consist of copper alloy and which have an inside diameter of 32.6 mm, a thickness of 0.8 mm and a width of 6 mm. Feeding rings 31, 32*a* and 32*b* are attached by a connection such that they are joined to conduct electricity to electrodes 131, 132*a* and 132*b* which are located on the two ends of heat generating resistance 13.

In the fixing device in this embodiment, by the arrangement of feeding rings 31, 32*a* and 32*b* as components of heat roller 10, a conductive sliding part, for example, a carbon brush, can be brought into contact with the feeding rings and can thus feed. In this way, voltage can be applied between feeding ring 31 and feeding ring 32*a*, and between feeding ring 31 and feeding ring 32*b*, even when heat roller 10 is turned. In this way, the surface of above described heat roller 10 can be subjected to heat temperature control.

Figure 6:
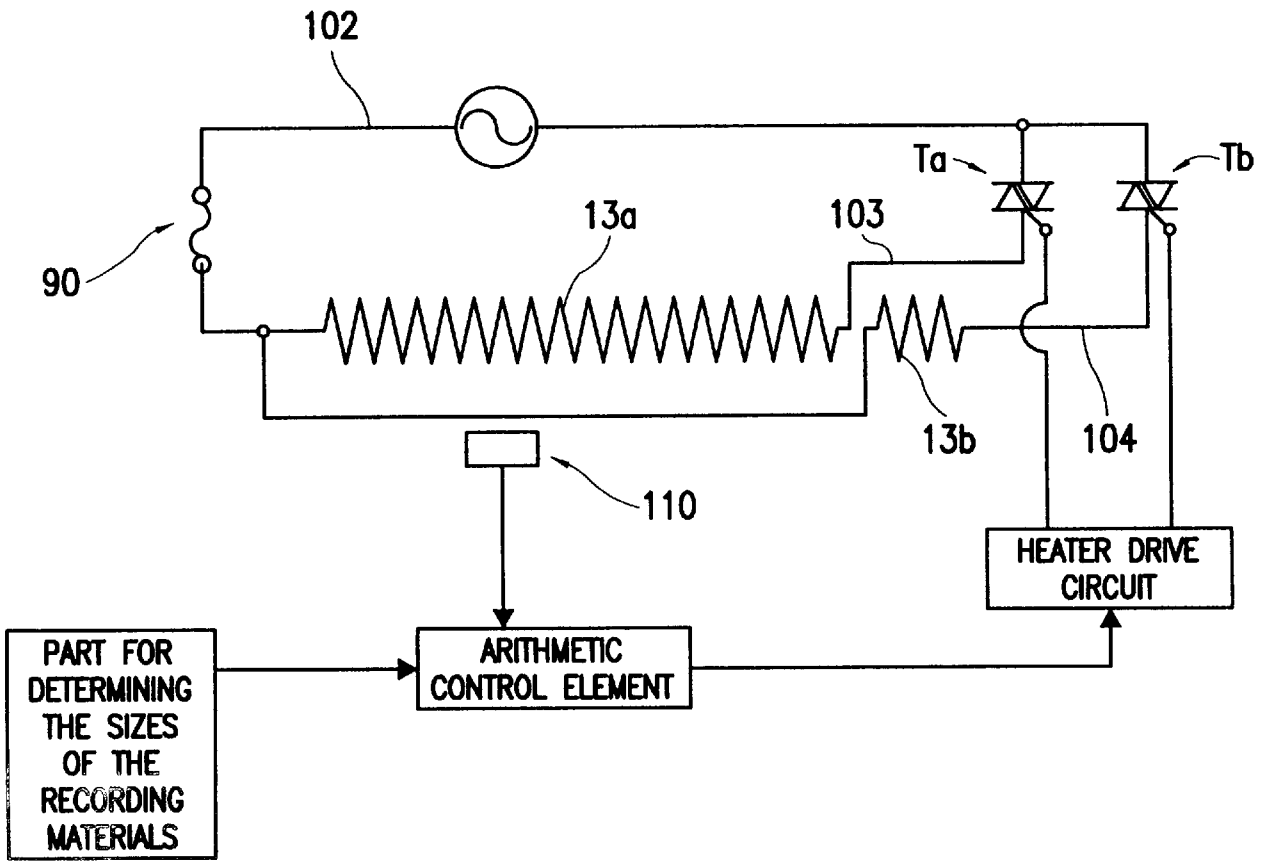
FIG. 6 schematically shows the temperature control of the heat roller.

FIG. 6 is a schematic of the temperature control of heat roller 10 which forms the heat roller device according to the invention. In FIG. 6, reference number 110 indicates the temperature sensor for determining the surface temperature of heat roller 10. The surface temperature of heat roller 10 is determined by temperature sensor 110 and its signals are sent to an arithmetic control element. Furthermore, with respect to the means for determining the sizes of the recording materials, the passage widths of the recording materials are determined by a conventional process known in the art. Signals which correspond to the passage widths of the recording materials are sent to the arithmetic control element.

In the arithmetic control element, the signals are received from temperature sensor 110 and from the means for determining the sizes of the recording materials. The power is computed and supplied to each of heat generating resistance 13*a* and heat generating resistance 13*b*. Based on this result, heat generating resistance 13*a* (13*b* ) can be turned on and off by turning on and off TRIAC element Ta (Tb) via a heater drive circuit. In this embodiment, the circuit is formed such that during the OFF state of the TRIAC element Ta, TRIAC element Tb is located in the OFF state.

In this embodiment, resistance values of heat generating resistances 13*a* and 13*b* are each adjusted such that when TRIAC Ta is "ON", the degree of heat generation in first area P is approximately 640 W, and when TRIAC Tb is "ON", the degree of heat generation in second area Q is approximately 280 W.

For preheating, to increase the surface temperature of heat roller 10 in this embodiment, up to the fixing temperature (for example, 180° C.), first of all, both TRIAC Ta and TRIAC Tb are turned on. By supplying current to two heat generating resistances 13*a* and 13*b*, the temperature of heat roller 10 is increased by the Joulean heat which is formed in the respective heat generating resistance.

The surface temperature of heat roller 10 is determined by temperature sensor 110 which is installed in the heat roller device. When the fixing temperature of heat roller 10 is reached, temperature control is complete and the stand-by state assumed.

In the preheat and stand-by states of the device, the passage width of the recording material used for fixing is not yet known. Temperature control is, therefore performed such that, according to the maximum passage width (transverse width of the A3 form), the fixing temperature is reached surrounding both first area P and also second area Q. This is accomplished specifically by assessing, in the arithmetic control element, whether the temperature determined by temperature sensor 110 is higher or lower than the temperature control set temperature and by simultaneously turning on and off both TRIAC Ta and TRIAC Tb as a result thereof.

In the following, the above described circumstances are described in more detail:

The ratio of the degree of heat generation between the two heat generating resistances present in first area P and second area Q is set such that when switched on without interruption, the surface temperature distribution in the longitudinal direction of the heat roller within the fixing area is in a generally uniform state. In this embodiment, when switched on without interruption, the degree of heat generation of heat generating resistance 13*a* is 640 W and the degree of heat generation of heat generating resistance 13*b* is 280 W. The ratio of the heating power (net heating power) is set to 1:0.438; this ratio being designated with the initial set value of the ratio of the net heating power. The reason for the above described establishment of the heating power of the heat generating resistances in first area P and second area Q, is that the computation was done as a result of the thermal capacity, and the like, of the cylindrical metal base material of the respective area.

Therefore, in the case of changes in the ratio of lengths in the longitudinal directions of first area P and second area Q to one another or in the case of changes of the material of the metal base material, its outside diameter, and its thickness and the like, the above described initial set value of the heat generating resistance in first area P and second area Q can be changed accordingly.

During fixing work, according to the passage widths of the recording materials used for fixing, the net heating power of the heat generating resistance located in area Q is reduced compared to the ratio of the initial set value. Specifically, this can be done by taking the time, regardless of the height or depth of the temperature determined by temperature sensor 110, during which TRIAC Tb is necessarily turned off for any period, hereinafter referred to as "forced OFF time", when TRIAC Ta is in the on state. Also, this can be done by recording the forced OFF time of TRIAC Tb beforehand in the arithmetic control element according to the passage times of the recording materials. The on-time for heat generating resistance 13*b* is shortened compared to the on-time for heat generating resistance 13*a*. This means that the net heating power of heat generating resistance 13*b* is reduced in comparison to the value which was set initially with reference to the initial average degree of heat generation per hour of heat generating resistance 13*a*.

Figure 7:
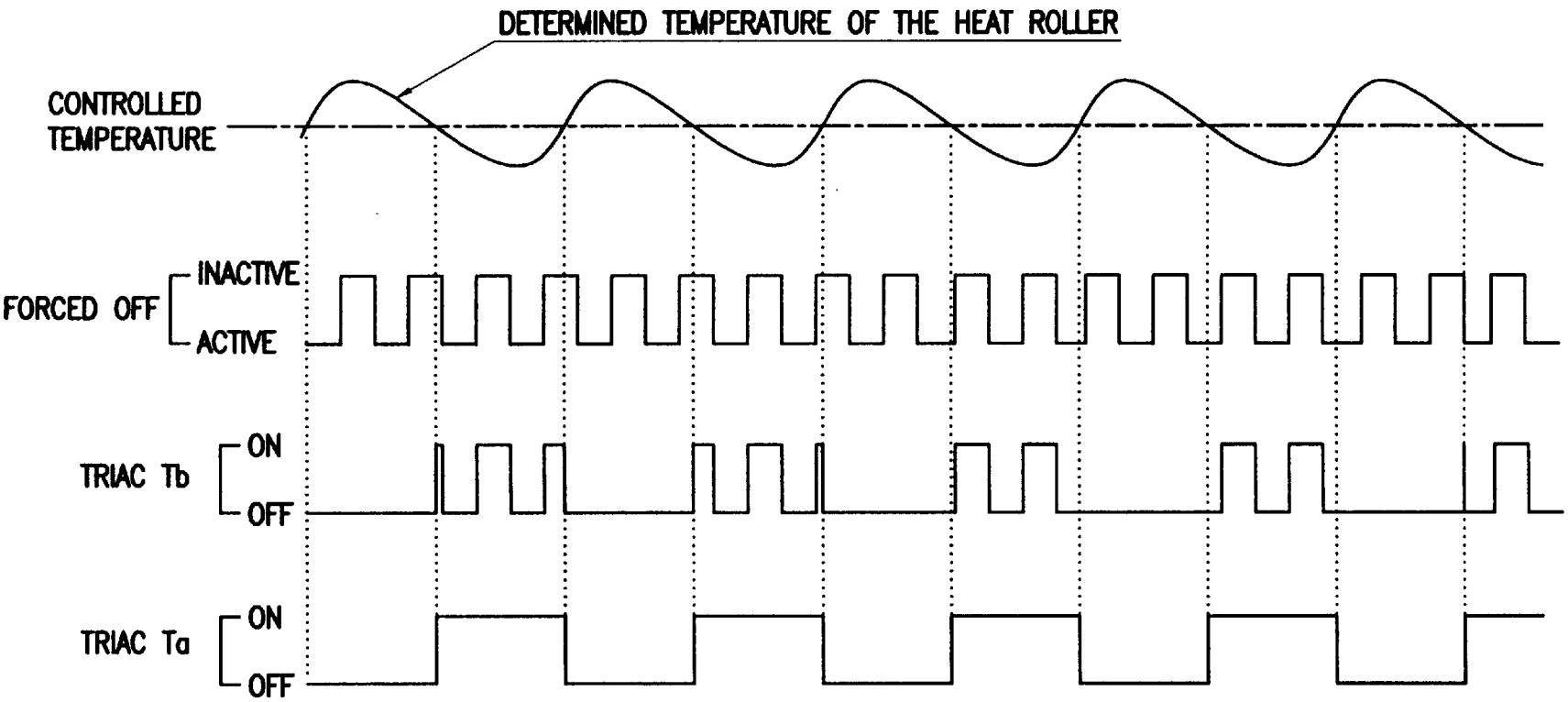
FIG. 7 schematically shows an operating time diagram which explains the determination of temperature and TRIAC operation.

If, for example, the forced OFF time of TRIAC Tb is set to 0.5 second per second, the net heating power of second area Q decreases by half thereof in the case in which a forced OFF time is not taken. FIG. 7 shows one example of the determination of temperature and operation of TRIAC Ta and TRIAC Tb using an operating time diagram.

Temperature sensor 110 is located in an overlapping site through which recording materials with different width travel. Therefore, even in the case of a recording material with a small passage width, the temperature of the paper transport area can be adjusted to the fixing temperature.

In the case in which a recording material which is used for fixing has the maximum passage width, heat is removed from heat roller 10 over the entire area of the maximum passage width of the recording material.

The net heating power of resistance heating elements 13*a* and 13*b*, which are located in first area P and second area Q, is therefore set to the same value as in the stand-by state. As a result, the surface of heat roller 10 is adjusted to a generally uniform temperature over the entire range of maximum passage width within a fixing area.

Furthermore, in the case in which a recording material used for fixing has a smaller passage width compared to the maximum passage width, the net heating power decreases in the non-paper transport area because heat is not removed from heat roller 10 in the non-paper transport area by the recording material. In this embodiment, the net heating power of heat generating resistance 13*b* located in second area Q compared to the net heating power of heat generating resistance 13*a* located in first area P is reduced, since the non-paper transport area is mainly in second area Q.

The smaller the passage width of the recording material becomes, the wider the non-paper transport area becomes. Therefore, the heating power (net heating power) of heat generating resistance 13*b* located in second area Q can be reduced accordingly. This means that the forced OFF time of TRIAC Tb is lengthened. As a result thereof, in the case in which a large amount of recording material with a smaller passage width than the maximum passage width is subjected to fixing work without interruption, the non-paper transport area of heat roller 10 is prevented from having an abnormal temperature increase.

However, the invention is not limited to the above described embodiment, but various changes can be effected.

Figure 8:
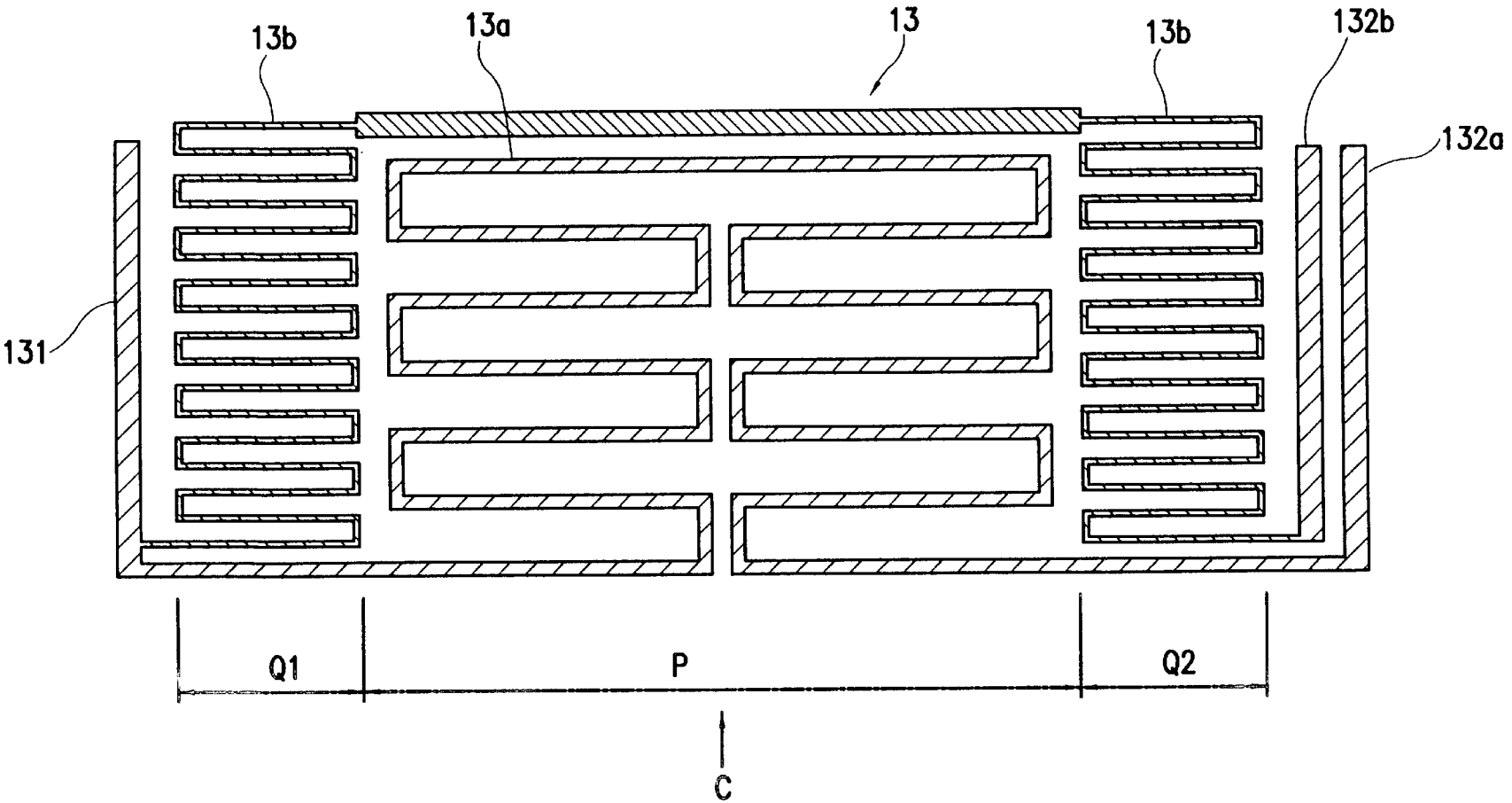
FIG. 8 schematically shows another typical model of a heat generating resistance which forms the heat roller.

In the above described embodiment, for example, paper transport was described with respect to side registration. However, it can also be used for center registration, as illustrated in FIG. 8. In the case of center registration, first area P is located in the middle region of the passage area for the recording material of the heat roller and second area Q is located on both ends of the recording material passage area by division into two areas of Q1 and Q2. This means that in spite of dividing second area Q into two parts, the heat generating resistance formed in the second area remains integral, although it is present in different positions. The supply arrangement for feeding electricity to the heat generating resistances is identical to the arrangement in the above described embodiment.

Figure 10:
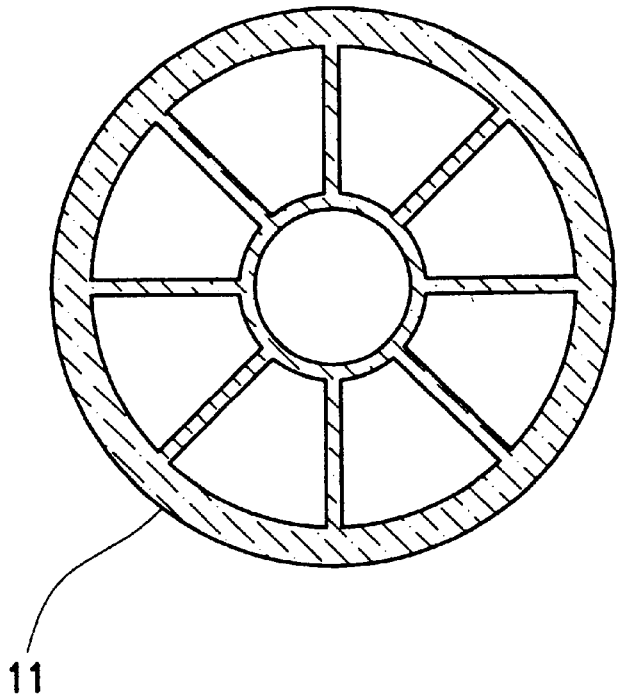
FIG. 10 schematically shows still another embodiment of the cylindrical base material which forms the heat roller.
Figure 9:
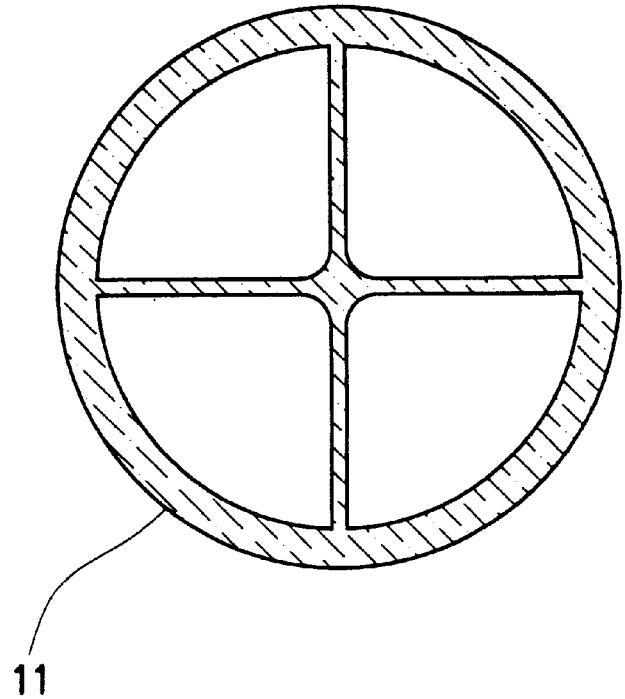
FIG. 9 schematically shows another embodiment of the cylindrical base material which forms the heat roller.

Base material 11 which forms heat roller 10 need not necessarily be hollow, but can also be filled. Nor is it limited to a perfect cylinder, but it is enough to be generally cylindrical in the area in which it can function as a roller. Moreover, by means of the cross sectional shape of cylindrical base material 11, shown in FIGS. 9 or 10, the mechanical strength of heat roller 10 can be increased. (Test example)

The surface temperature of the heat roller was measured, wherein, in the heat fixing device according to the invention, normal paper with smaller passage widths than the maximum passage width was subjected to paper transport. The maximum passage width is the transverse width of an A3 form (297 mm). The forms actually subjected to paper transport are an A4 form, a B5 form and a B4 form. The transverse width of the respective form (210 mm, 182 mm, 257 mm) being the passage width.

Figure 11:
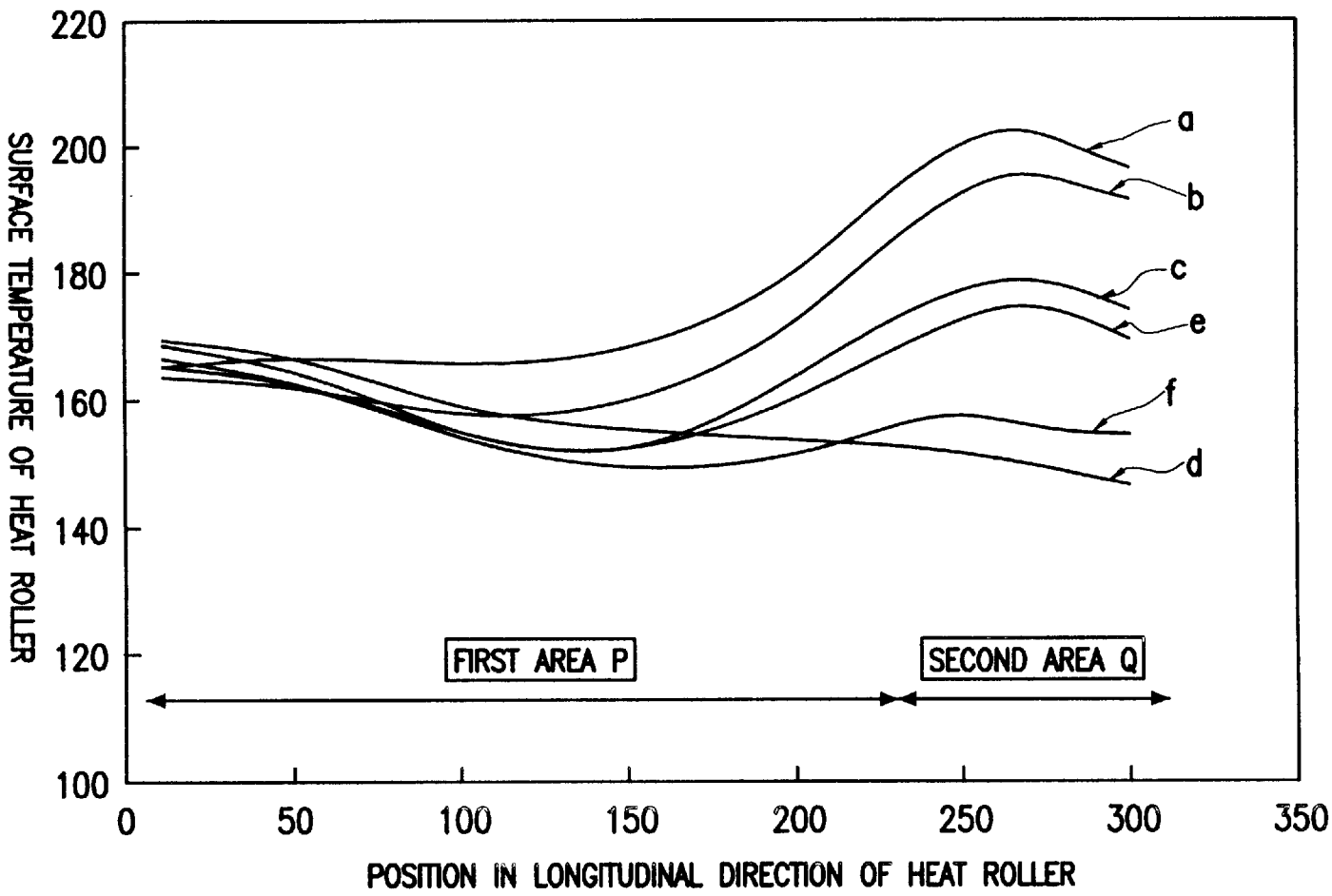
FIG. 11 shows a schematic of a test result with respect to a heat fixing device according to one embodiment of the invention.

The paper transport speed is 110 mm/s. In FIG. 11, the result of measuring the surface temperature of the heat roller is shown immediately after uninterrupted paper transport of 50 pages for the respective form.

FIG. 11 shows surface temperature distributions of the heat roller using curves a, b, c, d, e and f. Measurement conditions are shown using Table 1. In Table 1, the ratio in this test between the net heating power of heat generating resistance 13*a* and heat generating resistance 13*b* for the A4 form were made equal to the ratio thereof for the B4 form.

In this experimental example, the initial set value of the ratio between the heating power net heating power of heat generating resistance 13*a*, located in first area P, and the heating power net heating power of heat generating resistance 13*b*, located in second area Q in the preheat state and the stand-by state, is 1:0.429. A generally uniform distribution of the surface temperature in the longitudinal direction of the heat roller with maximum passage width can be achieved in this manner. Using curves a, b and c, temperature distributions are shown in the case in which, while maintaining this state, i.e., without having taken the forced OFF time for heat generating resistance 13*b* in the second area, fixing work was performed. In this case, the temperature in the vicinity of second area Q, which corresponds to the non-paper transport area, was unduly increased to approximately 200° C., because no heat was removed from the recording material.

On the other hand, in the cases shown using curves d, e and f, the excess temperature increase of the non-paper transport area was suppressed. Also, for heat generating resistance 13*b*, the forced OFF time was taken. In addition, paper transport was uninterrupted in the state in which the net heating power of heat generating resistance 13*b* located in second area Q was made smaller than the initial value set with respect to the initial net heating power of heat generating resistance 13*a*.

Curve e represents heat generation by heat generating resistance 13*a* in first area P and, in addition, heat generation to a certain degree by heat generating resistance 13*b* of second area Q for paper transport of the A4 form. Using Table 1, the ratio between the net heating power of heat generating resistance 13*a*, located in first area P, and the net heating power of heat generating resistance 13*b*, located in second area Q, is shown.

As becomes apparent from curve e, a generally uniform surface temperature within the fixing region is shown up to a position of 211.6 mm in the longitudinal direction of the heat roller in the case of paper transport of the A4 form. The surface temperature at a position greater than or equal to 211.6 mm in the longitudinal direction of the heat roller, which is the non-paper transport area, increases according to the amount of heat generation of heat generating resistance 13*b*, but not in an amount in which problems of thermal stress, and the like, of the heat roller occur.

This means that during paper transport of the A4 form, it is necessary to increase the temperature of area P from which heat is removed by the recording material. On the other hand, it is necessary not to increase the temperature of area Q from which no heat is removed by the recording material. The ratio between the net heating power of heat generating resistance 13*a* and the average degree of heat generation per hour of heat generating resistance 13*b*, is set to 1:0.299.

The reason for the decrease in the surface temperature of the heat roller in the vicinity of 150 mm in area P, to a small degree, in the case shown using curve e, is that the net heating power of the heat generating resistances in areas P and Q differ from one another, as was described above. As a result, the heat in area P of the cylindrical base material which forms the heat roller is transferred to area Q, and, consequently, in this vicinity, the surface temperature of the heat roller decreases.

Curve d represents heat generation by heat generating resistance 13*a* of first area P and, in addition, heat generation to an extremely small amount by heat generating resistance 13*b* of second area Q for paper transport of the B5 form. Using Table 1, the ratio between the net heating power of heat generating resistance 13*a*, located in first area P, and the net heating power of heat generating resistance 13*b*, located in second area Q, is shown.

As is apparent from curve d, up to a position of 188.5 mm in the longitudinal direction of the heat roller in the case of paper transport of the B5 form, a generally uniform surface temperature within a fixing region is achieved. The surface temperature at a position greater than or equal to 188.5 mm in the longitudinal direction of the heat roller which is the non-paper transport area, does not increase, but rather decreases since heat generating resistance 13*b* generates only the smallest amount of heat.

This means that, in paper transport of the B5 form, it is necessary to increase the temperature of area P from which heat is removed by the recording material. On the other hand, it is necessary not to increase the temperature of area Q from which no heat is removed by the recording material. The ratio between the net heating power of heat generating resistance 13*a* and the net heating power of heat generating resistance 13*b* is set to 1:0.176.

The reason the net heating power of heat generating resistance 13*b* was set to a rather small value, i.e., to 0.176, is that the B5 form has a small paper transport width and that only area P is used. The reason for the generally constant surface temperature of the heat roller at 160 mm to 270 mm in area P, in the example shown in curve d, is that the heat removed by the recording material and the heat generation in areas P and Q of the cylindrical base material are in equilibrium with one another.

Curve f represents heat generation by heat generating resistance 13*a* of first area P and, in addition, heat generation also by heat generating resistance 13*b* of second area Q for paper transport of the B4 form. Using Table 1, the ratio between the net heating power of heat generating resistance 13*a*, located in area P, and the net heating power of heat generating resistance 13*b*, located in area Q, is shown.

As is apparent from curve f, a generally uniform surface temperature within the fixing region is achieved up to a position of 260 mm in the longitudinal direction of the heat roller, in the case of paper transport of the B4 form. The surface temperature at a position greater than or equal to 260 mm in the longitudinal direction of the heat roller, which is the non-paper transport area, does not increase, but rather tends to decrease since heat generating resistance 13*b* generates only the smallest amount of heat.

This means that in paper transport of the B4 form, it is necessary to increase the temperature of area P from which heat is removed by the recording material. On the other hand, it is necessary, in order to prevent an excess temperature increase of the non-paper transport area of the heat roller, not to increase the temperature of area Q to a high degree, although heat is removed from it to a small degree by the recording material. The ratio between the net heating power of heat generating resistance 13*a* and the net heating power of heat generating resistance 13*b*, is set to 1:0.299.

The reason for the decrease of surface temperature of the heat roller in the vicinity of 170 mm in area P, to a small degree, in the example represented by curve f, is that the average degrees of heat generation per hour of the heat generating resistance in areas P and Q differ from one another, as was described above. As a result, the heat in area P of the cylindrical base material which forms the heat roller is transferred to area Q, and, consequently, in this vicinity, the surface temperature of the heat roller decreases.

As was described above, by dividing the heat generating resistance into two parts and by changing the ratio between the net heating power of the heat generating resistance located in first area P and the net heating power of the heat generating resistance body located in second area Q according to the different passage widths of the recording materials, an abnormal temperature increase of the non-paper transport area for uninterrupted paper transport can be suppressed. At the same time, within one fixing area, a generally uniform surface temperature, which corresponds to the passage width of the recording material, can be achieved in the longitudinal direction of the heat roller. Furthermore, only a minimum number of feeding rings, i.e., only three feeding rings, are enough since only two heat generating resistances are used.

TABLE 1

| Curve | Size of the form subjected to paper transport | Ratio between the net heating power of heat generating resistance 13a and the net heating power of heat generating resistance 13b |
|---|---|---|
| a | B5 | 1:0.429 |
| b | A4 | 1:0.429 |
| c | B4 | 1:0.429 |
| d | B5 | 1:0.176 |
| e | A4 | 1:0.299 |
| f | B4 | 1:0.299 |

The hot roller device according to the invention can be used not only for heating articles including a recording material on which a toner image is formed, but also for heating other articles such as, for example, a plastic film of a device for surface treatment of a coated which is usually called a laminator.

In these embodiments, the heating power net heating power was changed according to the passage widths of the articles to be heated. However, the heating power can also be changed according to the materials of the articles to be heated (paper/plastic), the thicknesses of the articles to be heated, and the like.

Action of the Invention

The heat roller device according to the invention results in a simple arrangement, low costs and a smaller device. These advantages are achieved using the present system by which the heat generation resistance is divided into two parts to increase the temperature of the heat roller in order to correspond to the passage widths of different recording materials, and by which these two heat generating resistances are turned on by three feeding rings.

Furthermore, by reducing the degree of heat generation by a heat generating resistance which is present in the non-paper transport area of the heat roller, according to the invention, the temperature increase of the non-paper transport area of the heat roller can be suppressed.

It is to be understood that although preferred embodiments of the invention have been described, various other embodiments and variations may occur to those skilled in the art. Any such other embodiments and variations which fall within the scope and spirit of the present invention are intended to be covered by the following claims.

We claim:

1. A heat roller device, comprising a heat roller and a press roller positioned opposite said heat roller, for heating an article passed between the two rollers, wherein said heat roller includes a generally cylindrical base material and two heat generating resistances formed on said cylindrical base material, each of said two heat generating resistance generating heat independently of one another, further including a common electrode for supplying current to said two heat generating resistances and separately arranged additional supply electrodes, and control means for separately turning on and off both of said two heat generating resistances as a function of the width of the article and the surface temperature of the heat roller in a manner varying the net heating power supplied to each of the two heat generating resistances and the ratio of the net heating power supplied to one of the two heat generating resistances relative to the net heating power supplied to the other of the two heat generating resistances.

2. The heat roller device according to claim 1, wherein the article to be heated is a recording material on which a toner image is formed, and said toner image is fixed.

* * * * *